US005208408A

United States Patent [19]

Cave

[11] Patent Number: 5,208,408

[45] Date of Patent: May 4, 1993

[54] SOUND POST FOR MUSICAL INSTRUMENTS

[76] Inventor: James G. Cave, 1324 NW. 6th St., Bend, Oreg. 97701

[21] Appl. No.: 786,038

[22] Filed: Oct. 31, 1991

[51] Int. Cl.[5] ..... G10D 3/00

[52] U.S. Cl. ..... 84/277

[58] Field of Search ..... 84/276, 277, 267, 291

[56] References Cited

U.S. PATENT DOCUMENTS

| | | | |
|---|---|---|---|
| 322,925 | 7/1885 | Hall . | |
| 547,150 | 10/1895 | Monson . | |
| 1,671,532 | 5/1928 | Lemansky et al. | 84/277 |
| 1,788,745 | 1/1931 | Rowland . | |
| 2,141,735 | 12/1938 | Borg | 84/277 |
| 2,145,237 | 1/1939 | Eberhart | 84/277 |
| 2,162,595 | 6/1939 | Virzi | 84/277 |
| 2,370,460 | 2/1945 | Patmor | 84/277 |
| 4,026,181 | 5/1977 | Barcus et al. | 84/277 X |

*Primary Examiner*—William M. Shoop, Jr.
*Assistant Examiner*—Jeffrey W. Donels
*Attorney, Agent, or Firm*—Kolisch, Hartwell, Dickinson, McCormack & Heuser

[57] ABSTRACT

An improved sound post (4) for musical instruments with a swivel device (28a, 28b) at either end. They allow the flat ends (29a, 29b) to make full and even contact with the inner surfaces of the top (21) and back (22) of the musical instrument. The invention has also a method of adjusting the length in a simple manner and appears to be a traditional sound post to most observers. A master craftsman is not required to properly fit and install it and traditional tools are used. Because of the enhanced fit the tone and playability of the instrument improve dramatically. The danger of sound post cracks is significantly reduced as the ends (29a, 29b) make full and even contact even if the sound post (4) is jarred well out of position.

14 Claims, 2 Drawing Sheets

FIGURE 4
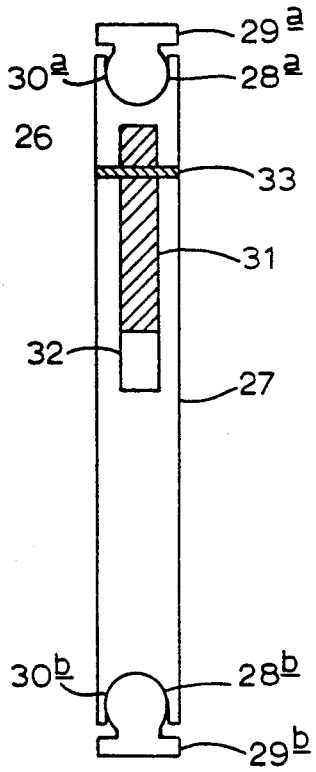
FIGURE 5
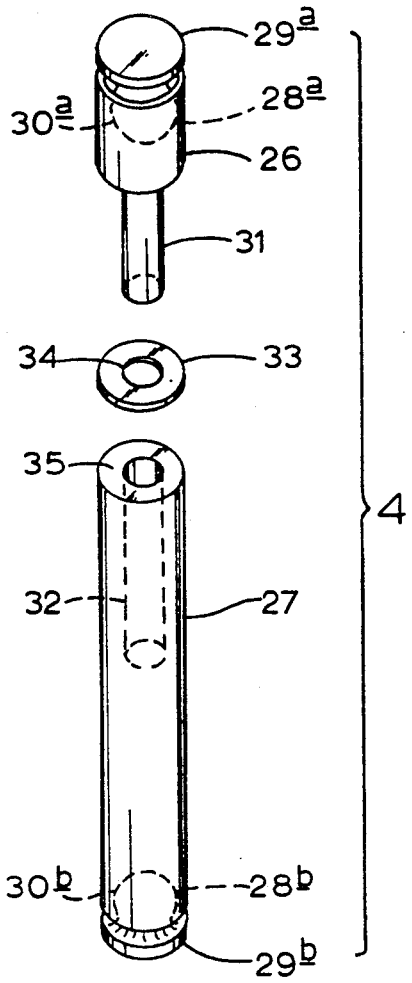
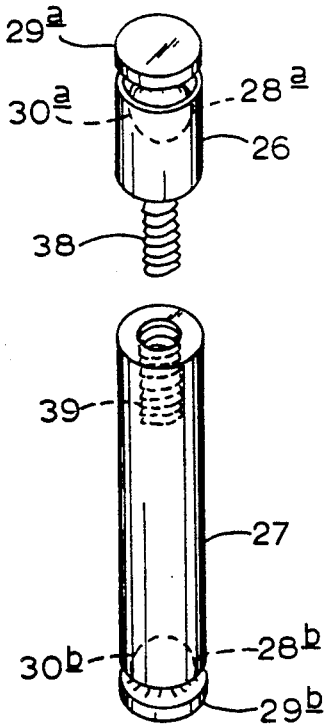
FIGURE 8
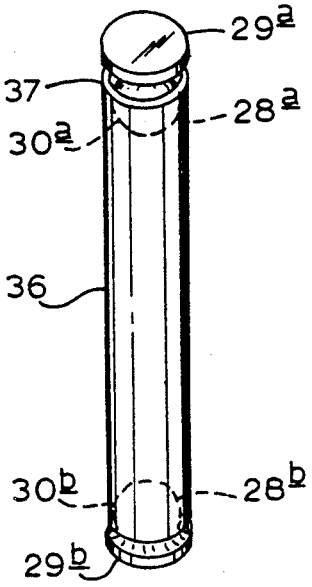
FIGURE 7

SOUND POST FOR MUSICAL INSTRUMENTS

BACKGROUND AND SUMMARY OF THE INVENTION

This invention relates to musical instruments, specifically to an improved sound post of which the ends adjust automatically to the inner surfaces of the vibrating plates on the top and back of stringed instruments. The invention also has an adjustable length.

A sound post in a violin or similar musical instrument is a supporting post which is friction fitted between the top of the instrument, beneath one foot of the bridge, and the back of the instrument. The exact position of a sound post in the violin family of musical instruments, its material, density, diameter, length, and closeness of fit with the inner surfaces of the top and back of the instrument, are crucial. They affect the quality of sound, playability, and physical health of the instrument. It requires a very high degree of skill to cut and fit a sound post to exactly the right length and have the ends fit precisely.

The sound post is cut and fit with no strings on the instrument. This allows for ease of viewing and judging the correct length. The instrument is then strung and brought to pitch.

The sound box of the instrument, comprising the top, back and sides beneath the bridge, undergoes distortions when it is brought to pitch. These distortions are well known in the art. They are small and not clearly visible to the naked eye but easily measured in the laboratory. When string tension changes, such as when changing brands or thickness of strings, the degree of distortion changes. Additionally, as the sound box is made of thin wood under high stress, daily fluctuations in temperature and humidity are sufficient to change the shape of the sound box and thus the degree of distortion.

It is also common practice to adjust the position of the sound post for optimum tone and playability. This can only be done after the instrument is playing and requires that the sound post be tapped to various positions, searching for the exact spot which gives the qualities desired by the owner. Obviously, once the sound post is moved from its original position it cannot fit the same.

The sound post which fits perfectly on the repairman's workbench soon fits less than perfectly because of use and atmospheric changes. And occasionally we find a sound post which could never have properly fit any instrument. It has been estimated by colleagues in the violin business that 75% to 95% of all sound posts do not fit properly.

Numerous patents have been issued to improve the sound post. Few, however, have directly addressed the critical fit of the ends to the inner surfaces of the top and back. A few patents, such as U.S. Pat. No. 322,925 (I. Hall, 1885 July 28), U.S. Pat. No. 547,150 (G. Monson, 1895 October 1), and U.S. Pat. No. 2,162,595 (G. Virzi, 1939 June 13) use padding to alleviate the mismatch. Besides muffling the sound, padding will not ensure full, even contact. The padding compresses more where there is more pressure, but there is still more pressure at those points. The padding evens out pressure variations somewhat but there is not full and even contact. U.S. Pat. No. 1,788,745 (S. Rowland, 1931 January 13) has a swivel mechanism but the device moves in only one plane, exactly as a screw "swivels" as it turns in or out. It does not move in more than one plane as is necessary to ensure full and even contact. U.S. Pat. No. 2,141,735 (A. Borg, 1938 December 27) has a pivot point but it is a locating pin and nothing pivots about it.

Several attempts have been made to adjust the length of the sound post. Several, U.S. Pat. No. 322,925 (I. Hall, 1885 July 28), U.S. Pat. No. 547,150 (G. Monson, 1895 October 1) and others, involve drilling holes through the top or back of the instrument. Such solutions are acceptable primarily to the patent holder.

To date no one has devised a sound post with ends which automatically fit the inner surfaces of the top and back, is easily adjusted for length by virtually anyone familiar with the art, which uses the traditional tools for installation and adjustment, and which does not appear unusual or strange to the player. It is an object of the present invention to provide an improved sound post which provides those features, as well as other advantages.

Further objects and advantages of my invention will become apparent from a consideration of the drawings and ensuing descriptions of it.

Accordingly, the invention provides a sound post for fitting between interior surfaces of a sound box on a stringed musical instrument. The sound post comprises a post having opposed ends, at least one end having a swivel platform with a flat surface thereon. The swivel platform allows the flat surface to be fitted against an interior surface of the sound box and to make full and even contact with the interior surface. In its preferred form, the invention provides a post with swivel platforms on each end. The swivel platforms can be swiveled in a plurality of planes to evenly contact the interior surface of the sound box. The length of the post is selected to frictionally fit the post between interior surfaces of the sound box with the flat surface on each swivel platform making full and even contact with the interior surfaces. A system for adjusting the length of the sound post is also provided.

BRIEF DESCRIPTION OF THE DRAWINGS

FIG. 4 shows a first embodiment of an improved sound post in accordance with my new invention, in partial cross section.

FIG. 5 is a partially exploded perspective view of the sound post of FIG. 4, with the upper sound post segment separated from the lower sound post segment.

FIG. 7 shows a partially exploded perspective view of a second embodiment of my invention.

FIG. 8 shows a third embodiment of my invention, in perspective.

DETAILED DESCRIPTION OF THE PREFERRED EMBODIMENT

Figure 1:
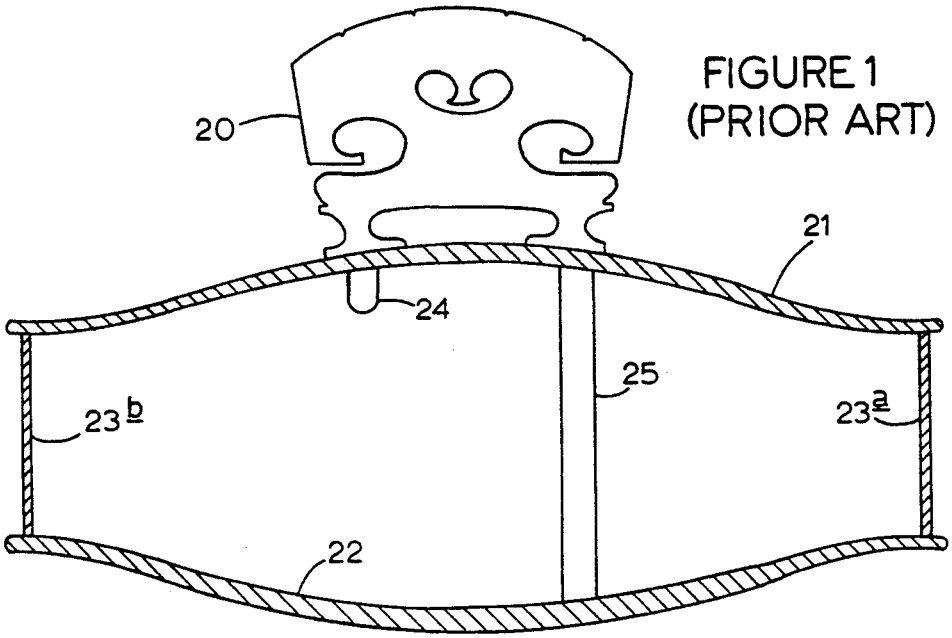
FIGURE 1 (PRIOR ART)
FIG. 1 shows a cross section of a violin sound box (prior art).
Figure 2:
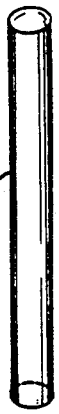
FIGURE 2 (PRIOR ART)
FIG. 2 shows a traditional sound post, illustrating the ends beveled to fit the inner surfaces of the top and back (prior art).

Referring to FIG. 1, prior art in the violin of musical instruments includes a sound box comprising a top 21, a back 22, a side 23*a*, a side 23*b*, and a bridge 20. (In the drawings, identical elements used in different places have the same numbers but different alphabetical suffixes.) Beneath one foot of bridge 20 is a support strut known as a bass bar 24. Slightly behind the other foot of bridge 20 is a supporting post known as a sound post 25, friction fitted between top 21 and back 22.

Figure 3:
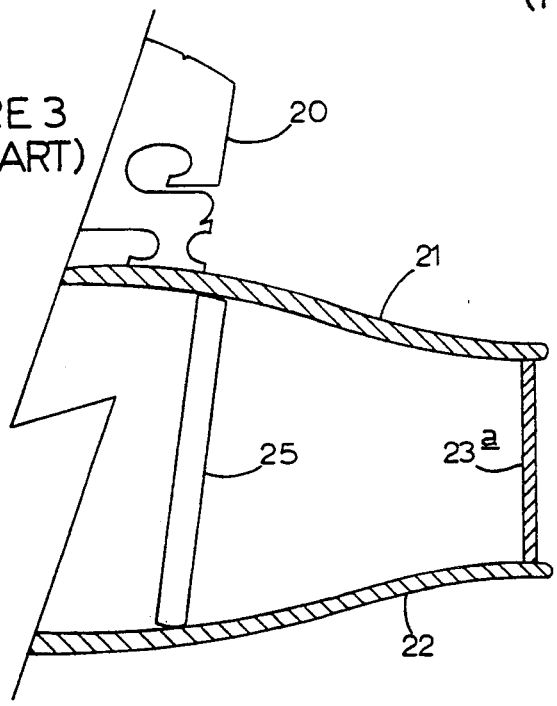
FIGURE 3 (PRIOR ART)
FIG. 3 shows a traditional sound post after it has been jarred out of position and is ready to cause a sound post crack (prior art).
Figure 6:
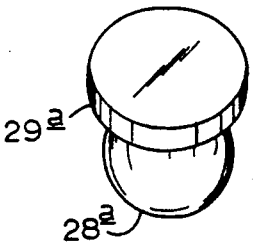
FIG. 6 shows a perspective view of one of the ball swivels installed on the ends of the sound post of FIGS. 4 and 5.

It is common that during normal use the instrument is periodically jarred or bumped, usually while in its case. Hitting a door frame is very common. Also, potholes, rough rail tacks, turbulent air and tumultuous seas may cause severe bumping and jarring. Should such occur the sound post may be moved out of position. In some cases the movement may be large. The sound post may then make contact over a very small area, causing localized points of very high pressure, as shown in FIG. 3. Given the thin and delicate nature of the top and back and the high stress levels, either or both can split in the sound post area. This is known as a sound post crack. Moving or adjusting a sound post, and temperature and humidity changes, cause similar misalignments of the post, although not as drastic as that shown in FIG. 3.

Sound post cracks are very upsetting to most owners. They require a high degree of skill to repair and are expensive to have done. The repair will always be visible, significantly affecting the value of the instrument, and will change its tone and playing characteristics.

To eliminate the problem of misalignment and improper placement of sound posts, my invention provides a new type of sound post illustrated in FIG. 4. At one end of my new sound post is a ball swivel 28*a*, a device selected from a group of devices capable of swiveling in one or a plurality of planes, with a flat platform 29*a* attached. Ball swivel 28*a* fits into a socket 30*a* in the end of an upper sound post segment 26. A locating pin 31 protrudes from the other end of upper segment 26. Pin 31 fits through a center hole 34 of a spacer 33 into a locating hole 32 in a lower sound post segment 27. Lower segment 27 terminates on the other end with a socket 30*b*. A ball swivel 28*b* with a flat platform 29*b* attached, fits into socket 30*b*.

Upper segment 26 is 8 mm long with a diameter of 6.2 mm. Locating pin 31 is 10 mm long with a diameter of 3 mm. Lower segment 27 may be 22 mm in length with a diameter of 6.2 mm. Locating hole 32 is 15 mm deep with a 3 mm diameter. Spacer 33 is 6.2 mm in diameter, 1 mm thick, with center hole 34 of 3 mm diameter. Flat platforms 29*a* , 29*b* are 6.2 mm in diameter. Ball swivels 28*a*, 28*b* are 4.768 mm in diameter and the ball sockets 30*a*, 30*b* are 4.762 mm diameter. Ball swivels 28*a*, 28*b* are formed on a lathe using a shaped cutter. Sockets 30*a*, 30*b* are formed by a ball end cutter. Dimensions of the parts are not critical except for ball swivels 28*a*, 28*b* and sockets 30*a*, 30*b*.

Dimensions given are appropriate for a violin sound post. Sound posts for other instruments are scaled accordingly.

Materials for the new invention are several. Spruce wood, the traditional material,, is preferred for upper segment 26 and lower segment 27. Plastics have been used and show promise. A plastic blend, as yet unknown to the inventor, may be the ideal material, especially for embodiments intended for student instruments. Locating pin 31 is birch wood, maple wood or spruce wood. Spacer 33 is made of plywood.

Ball swivels 28*a*, 28*b* are currently being made of maple wood, box wood, and the acetal family of plastics. The acetal plastics are currently preferred for their ease of machining and low friction. If plastic is used the surfaces making contact with top 21 and back 22 should be roughened slightly.

Operation of the preferred embodiment shown in FIGS, 4 and 5 begins with the repairman estimating the final length of sound post 4 in his usual manner. Upper sound post segment 26 and lower sound post segment 27 are separated. Spacer 33 is set aside. The repairman shortens lower segment 27 to slightly longer than its expected final length by trimming wood at an end 35. Trimming is preferably done with a sanding machine. Sound post 4 is reassembled, without spacer 33 and installed provisionally. Any additional amount to be trimmed at end 35 is estimated. Sound post 4 is removed again from the instrument, segments, 26, 27 are separated and lower segment 27 is trimmed again at end 35. The above, a method to vary the length of the post, is repeated until the desired final length is obtained. Should the repairman err and trim too much, spacer 33 is reinstalled between upper segment 26 and lower segment 27. Once the exact length has been obtained locating pin 31 may be glued into locating hole 32. Ball swivels 28*a*, 28*b* adjust automatically to the inner surfaces of top 21 and back 22 during the fitting operations.

In the embodiment shown in FIG. 7 the expected final length is estimated as earlier. Ball swivel 28*a* is removed and wood is removed at an end 37. Ball socket 30*a* is reformed and ball swivel 28*a* is inserted. Sound post 36 is installed provisionally and any additional length to be removed is estimated. Sound post 36 is removed, ball swivel 28*a* is removed, and end 37 is trimmed. A new ball socket 30*a* is formed. Swivel 28*a* is reinserted into socket 30*a*. The above steps are continued until sound post 36 is the correct length. Ball swivels 28*a*, 28*b* adjust automatically to the inner surfaces of top 21 and back 22.

In the embodiment shown in FIG. 8 no trimming is necessary. Length is adjusted by rotating upper sound post segment 26 and attached threaded locating pin 38. As a threaded locating hole 39 is in lower segment 27, the upper and lower sound post segments 26, 27 adjust in length.

After the new sound post shown in FIGS. 4, 5, 7, or 8 is at the correct length and in place, bridge 20 and strings are installed. The strings are brought to pitch and any adjustments to the sound post position are made.

Thus the reader can see that the sound post of the invention provides a highly effective yet economical means of precisely fitting a sound post. It can be installed by anyone familiar with the art. Less time is required for installation than for the traditional sound post and a master craftsman is not required. The economies are evident.

The tools required to install the new invention are the traditional violin maker's tools and the player will likely see no unusual aspect of it. The danger of sound post cracks is diminished dramatically.

Several objects and advantages of my new invention are: the upper and lower ends of the sound post make full and even contact with the inner surfaces of the top and back; the tone and playability of the instruments into which it is installed improve dramatically; the potential for sound post cracks is diminished drastically; the sound post is easily fitted by anyone familiar with the art, not necessarily a master craftsman; the customary tools are used to insert, remove, and adjust the new sound post; and the new invention looks like the traditional sound post to most observers.

Regardless of distortions caused by string tension or temperature and humidity changes the new sound post will automatically make full and even contact with the top and back. Full and even contact will be maintained when the sound post is tapped into new positions to regulate the sound and playability. Additionally, should the instrument be jarred the new sound post ends will made full and even contact even though it has been knocked many degrees off vertical. This will significantly alleviate the danger of sound post cracks and subsequent unpleasant consequences.

Because of the exceptional contact made by the new sound post ends, the tone of the instrument improves dramatically. Numerous instruments have been tested with the new invention. They included new and old instruments, good quality and poor, expensive and cheap, with good and poor fitting traditional sound posts. The new sound post increases speed of response, volume, fullness of sound, projection, and resonance. The pitch center is easier to find and thus the instrument is easier to play in tune. These changes have been dramatic in many cases, highly beneficial, and consistent.

Even instruments with excellent tone and well fitted traditional sound posts have benefited. In addition to the results noted, the better quality instruments acquire a more mellow tone, a quality highly desired by most players. The same type of phenomena occurred with instruments having particularly harsh, strident, or unpleasant tones. These negative qualities were cut severely by the new invention and the instruments became pleasant to hear.

The tools used to install, remove, and adjust the new sound post are the traditional violin maker's tools, of several different designs. The craftsman may use what he is familiar with. To adjust the length requires a common sanding machine, a knife, or a chisel. No high degree of skill is required.

The player will probably note nothing different physically about the new sound post. A good light and specific intentions are needed to see the small swivel at the lower end of the sound post. The upper end is visible only with a good light and an inspection mirror.

Use of the new sound post results in highly desirable changes in virtually all aspects of the instruments' tone and playing qualities. Many instruments, of all qualities, have been used for prototype testing. To date their owners and I have found only highly positive results from the invention.

While a violin sound post is used for illustrative purposes, the invention is not limited to the violin family. It can be used with the viol family, including but not limited to the viola d'amore, the viole de gamba, and the viole de braccio. It can be used in any bowed, plucked, percussion, wind, or any other type of musical instrument in which a sound post or supporting post is desired. It may be used in any application in which two surfaces are connected by a post and full and even contact of the post ends with the surfaces is desired.

While my above descriptions contain many specificities these should not be construed as limitations on the scope of the invention, but rather exemplifications of three embodiments thereof. For example, length of the invention may be varied by a rack and pinion, by a ratchet, by a cam, by a post with pin, by a conical sleeve, or by other means. Cross-sectional shape may be circular, oval, ovoid, triangular, square, rectangular, hexagonal, octagonal, or any other shape. It may have fluted sides or have holes or depressions at any point and at any angle and depth. The length may be of uniform diameter, barrel shaped, hourglass shaped, tapered, stepped, or compounds of any or all of these. Holes or depressions may be in the swivel ends or in the flat platforms at any point, at any angle, and of any depth. The flat platforms can be of any cross-section. One end only of the sound post may have a swivel or a swivel type other than a ball swivel may be used. Projections may occur at any point on the invention, at any angle, of any shape, of any size. Materials used may be wood, plastic, rubber, glass, metal, bone, ivory, or any combination thereof.

Accordingly the scope of the invention should be determined not by the embodiments illustrated or by the materials listed or musical instruments used for illustrative purposes but by the appended claims and their legal equivalents.

I claim:

1. A sound post for fitting between interior surfaces of the top and back vibrating plates of a sound box on a stringed musical instrument, the sound post comprising:

a post having opposed ends, at least one end of said post having a swivel platform with a flat surface thereon which can swivel in a plurality of planes to fit against an interior surface of a sound box to make full and even contact with the interior surface.

2. A sound post as in claim 1 in which said post has a swivel platform at each end thereof, and each said swivel platform has a flat surface thereon which can be swiveled in a plurality of planes to fit against an interior surface of the sound box.

3. A sound post as in claim 1 in which said at least one end of said post has a ball socket formed therein, and said swivel platform includes a ball swivel which fits into said ball socket to form said swivel platform.

4. A sound post as in claim 1 in which said post includes two separatable segments.

5. A sound post as in claim 4 in which one segment of said post includes a protruding pin extending therefrom and the other segment includes a cooperating hole into which said pin fits when the sound post is installed in a sound box.

6. A sound post as in claim 4 in which one segment of said post includes a threaded pin which protrudes therefrom and the other segment includes a threaded hole therein for receiving said threaded pin, whereby the length of said post is selectable by relative rotation between said segments.

7. A sound post as in claim 1 in which said post is made of wood and said swivel platform is made of plastic.

8. A sound post for fitting frictionally between facing interior surfaces of a sound box on a stringed musical instrument, the sound post comprising:

a post having opposed ends, a swivel platform on each end of said post, each said swivel platform including a flat surface which can be swiveled in a plurality of planes to contact an interior surface of a sound box on a stringed musical instrument, and the length of said post being selected to frictionally fit said post between interior surfaces of the sound box with said flat surface on each said swivel platform making full and even contact with such interior surfaces.

9. A sound post as in claim 8 in which said post includes an upper segment and a lower segment separable from one another, said upper segment including a pin extending therefrom and said lower segment including a locating hole for receiving said pin therein when the two segments are assembled to from said post, whereby the length of said post can be shortened by trimming one said segment.

10. A sound post as in claim 9 including a spacer element for inserting between said upper and lower segments to lengthen said post.

11. A sound post as in claim 8 in which each end of said post includes a ball socket formed in the end of the post and a ball swivel which fits into said ball socket to form said swivel platform.

12. A sound post as in claim 11 in which said post is made of wood and said ball swivels are made of plastic and said ball swivels each are slightly larger in diameter than said ball sockets.

13. A sound post as in claim 8 in which one segment of said post includes a threaded pin which protrudes therefrom and the other segment includes a threaded hole therein for receiving said threaded pin, whereby the length of said post is selectable by relative rotation between said segments.

14. A sound post as in claim 8 in which said post is made of wood and said swivel platforms are made of plastic.

* * * * *